US012338720B2

(12) United States Patent
Jackson et al.

(10) Patent No.: US 12,338,720 B2
(45) Date of Patent: Jun. 24, 2025

(54) SLEEVE DEVICE, METHOD AND SYSTEM

(71) Applicant: Baker Hughes Oilfield Operations LLC, Houston, TX (US)

(72) Inventors: Todd C. Jackson, Houston, TX (US); Ricardo Arturo Gomez Barker, Houston, TX (US); Mark Adam, Houston, TX (US); James Sanchez, Spring, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 47 days.

(21) Appl. No.: 18/185,776

(22) Filed: Mar. 17, 2023

(65) Prior Publication Data

US 2023/0296009 A1 Sep. 21, 2023

Related U.S. Application Data

(60) Provisional application No. 63/320,832, filed on Mar. 17, 2022.

(51) Int. Cl.
*E21B 43/27* (2006.01)
*E21B 34/06* (2006.01)
(Continued)

(52) U.S. Cl.
CPC ..... *E21B 43/27* (2020.05); *E21B 34/14* (2013.01); *E21B 34/063* (2013.01);
(Continued)

(58) Field of Classification Search
CPC ..... E21B 43/27; E21B 34/14; E21B 34/103; E21B 34/142; E21B 2200/06
See application file for complete search history.

(56) References Cited

U.S. PATENT DOCUMENTS 8,662,162 B2 3/2014 Kellner et al.
9,279,311 B2 3/2016 Kellner et al.
(Continued)

FOREIGN PATENT DOCUMENTS

AU 2016315921 B2 3/2017
WO 2014142849 A1 9/2014

OTHER PUBLICATIONS

Notification of Transmittal of the International Search Report and the Written Opinion of the International Searching Authority, or the Declaration; PCT/US2023/015454; Mail date: Jul. 5, 2023; 10 pages.

*Primary Examiner* — Nicole Coy
*Assistant Examiner* — Nicholas D Wlodarski
(74) *Attorney, Agent, or Firm* — Baker Hughes Company

(57) ABSTRACT

A method of conducting a plurality of downhole operations with a completion system, the method including performing a treatment through a port in a first sleeve assembly in a first stage of the completion system, using an object to slide a first sleeve in a second sleeve assembly, located uphole of the first sleeve assembly, in a second stage of the completion system to reveal a port, and then closing the port in the first sleeve assembly in the first stage using the object, performing a treatment through the port in the second sleeve assembly, closing the port in the second sleeve assembly, and opening at least one of the ports in the first sleeve assembly and the second sleeve assembly and producing fluids through the at least one of the ports. A completion system includes the sleeve assemblies and object for performing the method.

20 Claims, 7 Drawing Sheets

(51) Int. Cl.

| | |
|---|---|
| ***E21B 34/10*** | (2006.01) |
| ***E21B 34/14*** | (2006.01) |
| ***E21B 43/14*** | (2006.01) |

(52) U.S. Cl.
CPC ..... *E21B 34/103* (2013.01); *E21B 34/142* (2020.05); *E21B 43/14* (2013.01); *E21B 2200/06* (2020.05)

(56) References Cited

U.S. PATENT DOCUMENTS

| | | | | |
|---|---|---|---|---|
| 10,184,316 | B2 | 1/2019 | Flores Perez et al. | |
| 11,512,572 | B2 | 11/2022 | Thomas et al. | |
| 2011/0192613 | A1 | 8/2011 | Garcia et al. | |
| 2015/0000921 | A1* | 1/2015 | Harris | E21B 43/27 166/305.1 |
| 2017/0067314 | A1 | 3/2017 | Flores Perez et al. | |
| 2017/0218725 | A1* | 8/2017 | Schnell | E21B 34/14 |
| 2017/0335175 | A1* | 11/2017 | Oliveira | E21B 43/26 |
| 2018/0347330 | A1* | 12/2018 | Facca | E21B 34/14 |
| 2019/0055800 | A1 | 2/2019 | Stone et al. | |
| 2023/0018564 | A1 | 1/2023 | Thomas et al. | |

* cited by examiner

SLEEVE DEVICE, METHOD AND SYSTEM

CROSS REFERENCE TO RELATED APPLICATIONS

This application claims the benefit of an earlier filing date from U.S. Provisional Application Ser. No. 63/320,832 filed Mar. 17, 2022, the entire disclosure of which is incorporated herein by reference.

BACKGROUND

A multi-zone completion the string, that might be utilized in the resource recovery or fluid sequestration industries, has an array of sleeves selectively movable to block or permit ports to block or provide access, respectively, to each zone. These sleeves are typically run in closed so that tubing pressure can be built up to set tools such as external packers. A treatment sleeve can be shifted to open an treatment port through which treatment of the formation can take place. One such treatment is fracturing but others such as acidizing can also take place through the treatment port. When the treatment is completed, the treatment sleeve can be closed and a production sleeve opened to provide access to a production port which is screened to prevent solids from the surrounding formation from entering the production string. Sometimes these two sleeves are integrated into a single sliding sleeve that is shifted with a shifting tool into the treatment and the production positions.

The art would be receptive to improvements in methods and systems that would increase efficiency in a completion.

SUMMARY

An embodiment of a method of conducting a plurality of downhole operations with a completion system, the method including performing a treatment through a port in a first sleeve assembly in a first stage of the completion system, using an object to slide a first sleeve in a second sleeve assembly, located uphole of the first sleeve assembly, in a second stage of the completion system to reveal a port, and then closing the port in the first sleeve assembly in the first stage using the object, performing a treatment through the port in the second sleeve assembly, closing the port in the second sleeve assembly, and opening at least one of the ports in the first sleeve assembly and the second sleeve assembly and producing fluids through the at least one of the ports.

An embodiment of a completion system including a string of downhole tools arranged for a plurality of downhole operations, the completion system including settable packers arranged to separate adjacent stages of the string from each other, a toe sleeve in a first stage of the string, the toe sleeve including a housing, a radial port in the housing, a hydraulically openable sleeve initially arranged to cover the port, and an object-activated sleeve having an object seat, the hydraulically openable sleeve slidable to reveal the port to open a circulation path, a first sleeve assembly in the first stage, the first sleeve assembly including a housing having a radial port, a first sleeve having an object seat, the first sleeve initially arranged to cover the port in the housing of the first sleeve assembly, a consumable plug positioned in the port, and a second sleeve having an object seat, a second sleeve assembly in a second stage of the string, the second sleeve assembly including a housing having a radial port, a first sleeve having an object seat, the first sleeve of the second sleeve assembly initially arranged to cover the port in the housing of the second sleeve assembly, a consumable plug positioned in the port in the housing of the second sleeve assembly, and a second sleeve having an object seat, wherein the first sleeve in the first sleeve assembly is movable to reveal the port in the housing of the first sleeve assembly upon receipt of an object in the object seat of the first sleeve in the first sleeve assembly, the first sleeve of the second sleeve assembly is movable to reveal the port in the housing of the second sleeve assembly upon receipt of a second object in the object seat of the second sleeve in the second sleeve assembly, the second sleeve in the first sleeve assembly is movable to close the port in the housing of the first sleeve assembly upon receipt of the second object in the object seat of the second sleeve in the first sleeve assembly, and the object-activated sleeve in the toe sleeve is movable to close the port in the toe sleeve upon receipt of the second object.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
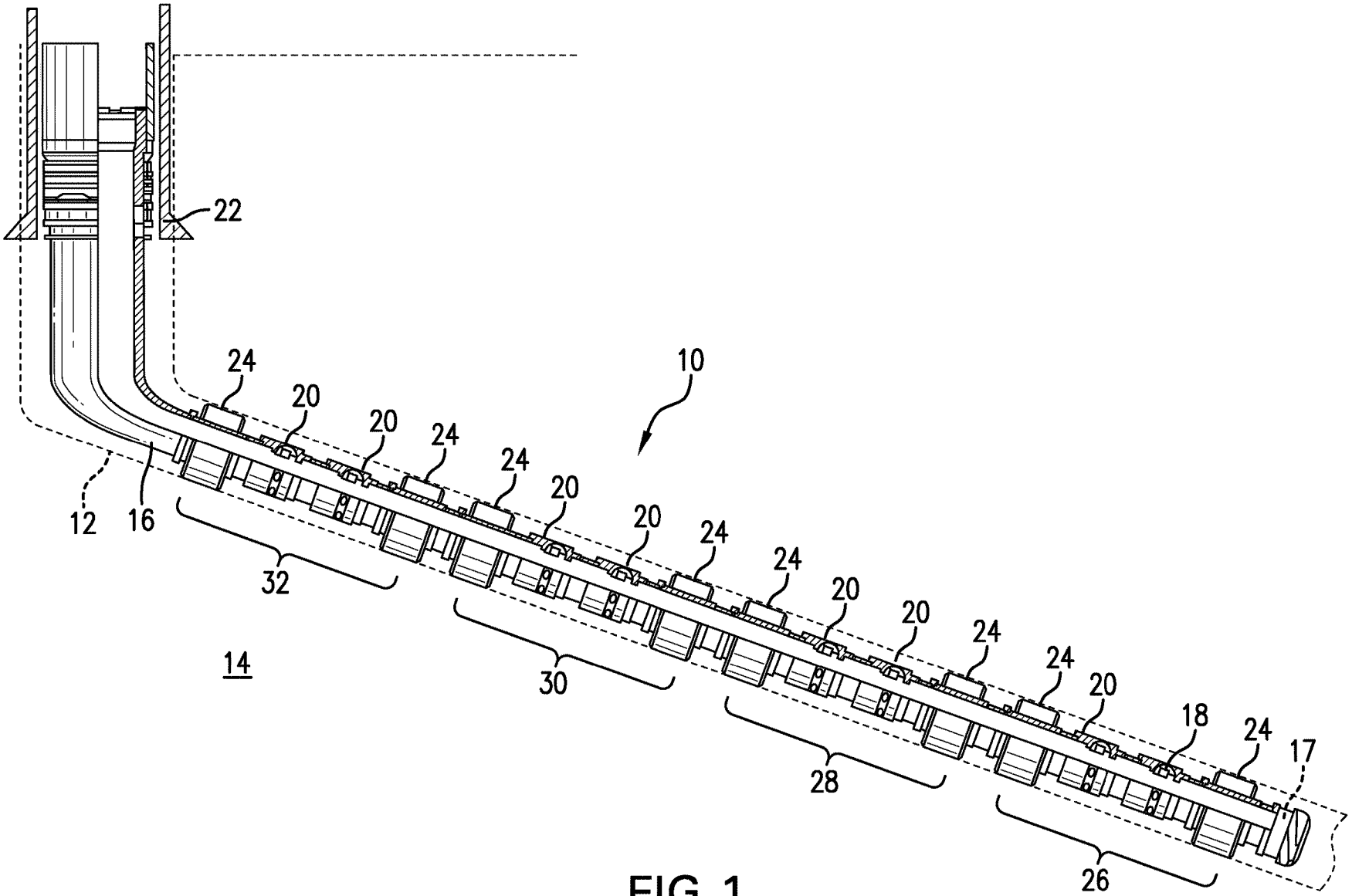
FIG. 1 depicts a partial side view of an embodiment of a completion system.

Referring to FIG. 1, a completion system 10 is shown. The system 10 includes a borehole 12 having a borehole wall in a subsurface formation 14 and a string 16 is disposed within the borehole 12. In the illustrated embodiment of the completion system 10, the borehole 12 is uncemented. As will be further described below with respect to FIG. 2, a toe sleeve 18 is disposed within or as part of the string 16 disclosed herein. Also, as will be further described below with respect to FIG. 3, sleeve assemblies 20 (sleeve devices) are disposed within or as part of the string 16 disclosed herein.

With further reference to FIG. 1, one embodiment of a starting condition and beginning operational method of the completion system 10 is as follows. A casing is set and a hole is drilled to total depth through carbonate zones in the formation 14 with water based mud. Lower completion is washed and reamed to total depth on a liner hanger system 22. A wellbore isolation valve 17 is run above a shoe to close the shoe off. The settable packers 24, such as hydraulically set open hole packers 24, are run in string 16 for isolation of zones. The toe sleeve 18 is run at the bottom of a first stage 26 to open circulation path with pressure. A sleeve assembly 20 is also run in the first stage 26, and multiple sleeve assemblies 20 are run in the second, third, and fourth stages 28, 30, and 32, respectively. While two sleeve assemblies 20 are depicted per stage, alternate embodiments may include additional or fewer sleeve assemblies 20. Also, while four stages 26, 28, 30, and 32 are depicted, the string 16 may include additional or fewer stages.

To set the hanger 22, a ball or other object is dropped and then sheared out to the shoetrack (float joint). Another ball or object is dropped to release the running tool, and that ball is also sheared out to shoetrack. Optionally, the open hole is displaced at high rates, such as, but not limited to approximately 17 barrels per minute for liner hanger or open hole packer limit. The open hole packers 24 are then set hydraulically with a ball or dart or other object landed in the wellbore isolation valve 17. The tools are then picked up and weight slacked off while rotating to set a liner top packer and the running tools are pulled out of the hole.

Figure 2:
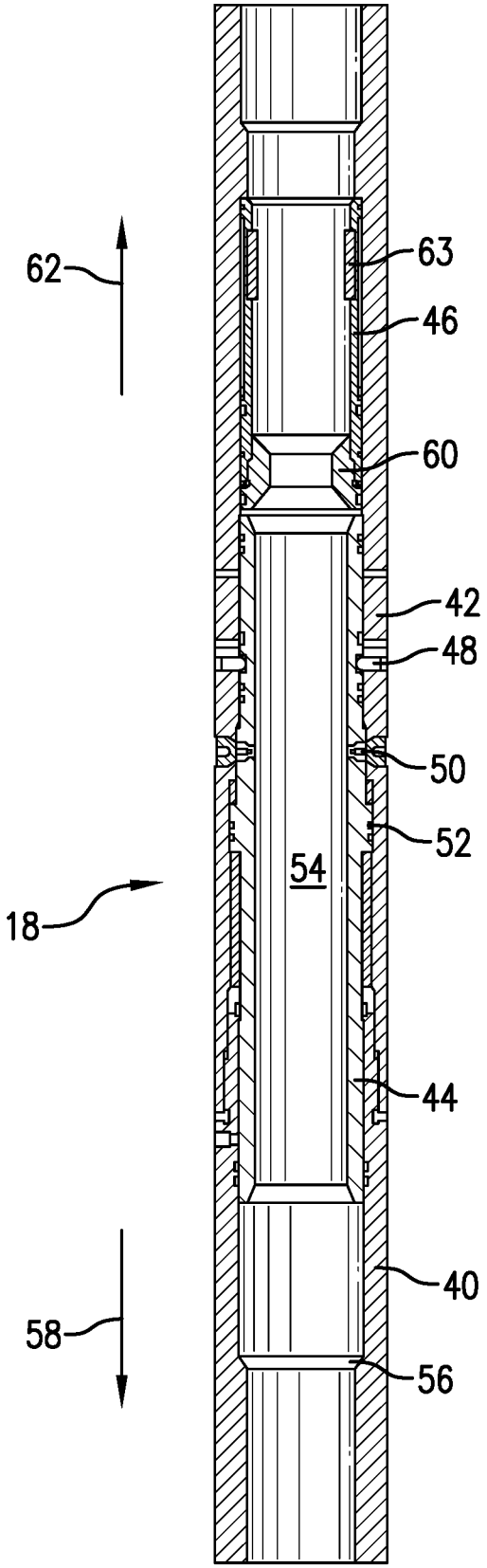
FIG. 2 depicts an interior view of an embodiment of a toe sleeve 18 for the completion system of FIG. 1.
Figure 5:
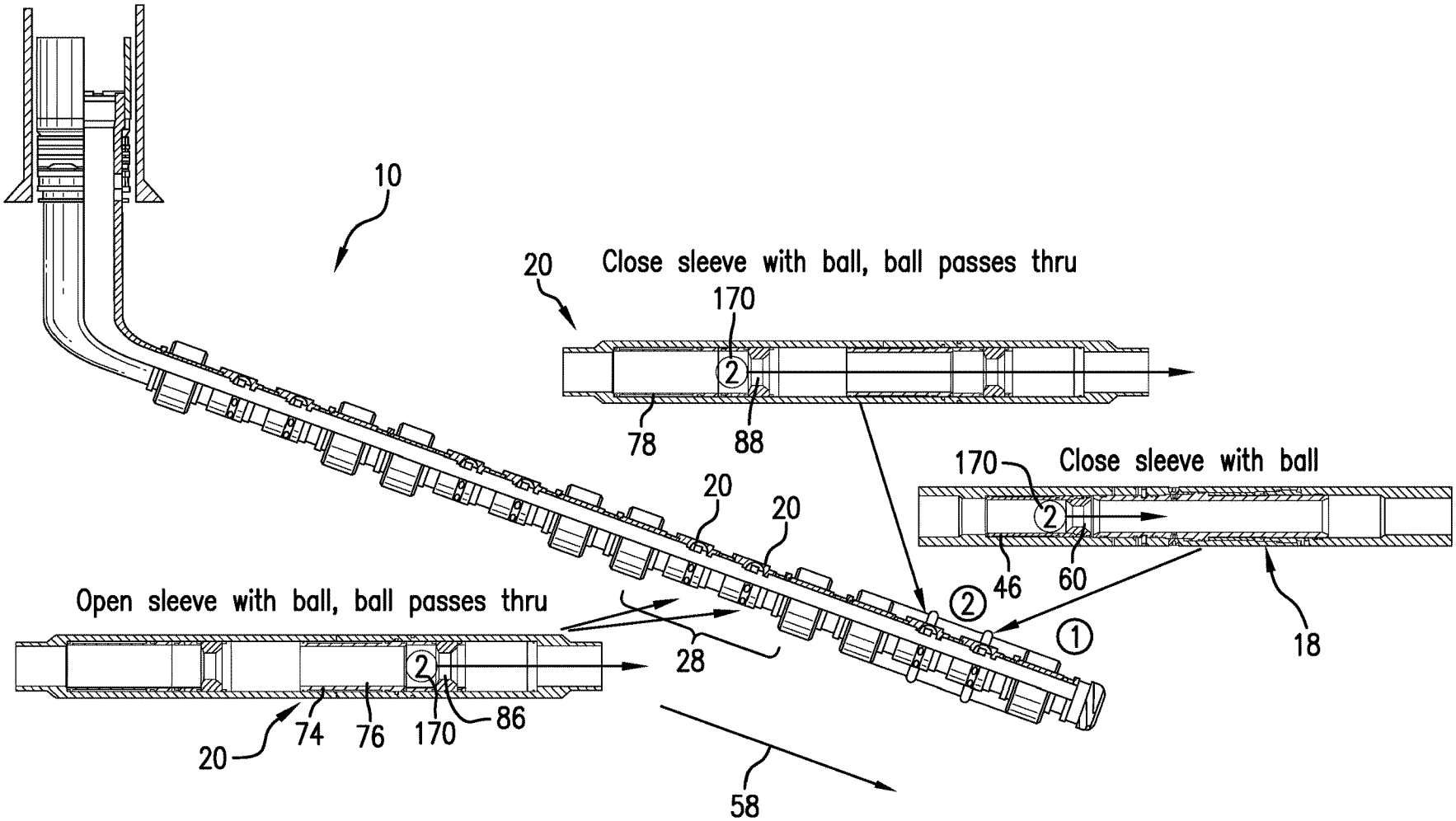
FIG. 5 depicts a schematic view of operations in a first stage and a second stage of the completion system of FIG. 1 employing the toe sleeve 18 of FIG. 2 and the sliding sleeve assembly of FIG. 3.

The toe sleeve 18 (FIG. 2) is then utilized to open the string 16 for circulation. With reference to FIG. 2, the toe sleeve 18 is a reclosable sleeve utilized to initiate circulation. The toe sleeve 18 is run at the bottom of the lower zone (e.g. first stage 26) or in a sump below to open a circulation path after setting the hydraulic open hole packers 24 above the wellbore isolation valve 17. The toe sleeve 18 includes a housing 40 having one or more radial ports 42 and housing a first sleeve 44 and a second sleeve 46, both movable axially within the housing 40. In an initial condition, the first sleeve 44 blocks the ports 42 and axial movement of the first sleeve 44 relative to the housing 40 is prevented, such as by one or more shear pins 48 that extend radially into the housing 40 and hold the first sleeve 44 in position until a certain shear force is exceeded. The first sleeve 44 is openable hydraulically. One or more rupture discs 50 in the first sleeve 44 is rupturable to dump pressure on a piston 52 to shift the first sleeve 44 open by shearing the shearing pins 48 and revealing the interior 54 of the housing 40 to the ports 42 and thus providing fluid communication between the interior 54 of the housing 40 and the surrounding zone of the borehole 12, such as fir acid stimulation and circulation. The housing 40 includes a reduced inner diameter shoulder 56 that prevents the first sleeve 44 from further movement in a downhole direction 58. The ports 42 are reclosable (blocking fluid communication between the interior 54 of the housing 40 and the surrounding borehole 12) using the second sleeve 46. The second sleeve 46 includes an object seat 60, such as ball seat 60. As illustrated, the ball seat 60 is a solid ball seat, but may alternatively be replaced by a segmented seat. When an object, such as a ball (a second ball as shown in FIG. 5), lands on the ball seat 60 and pressure is increased above the ball, the second sleeve 46 is shifted towards the first sleeve 44 such that the second sleeve 46 blocks the ports 42 in the housing 40. The second sleeve 46 further includes a shifting profile 63 usable to shift the second sleeve 46 in an uphole direction 62 to again reveal the ports 42 for production, and also usable to shift the second sleeve 46 in the downhole direction 58 to cover the ports 42 to shut off the zone adjacent the first stage 26. Thus, the toe sleeve 18 is employable to stimulate, test, close, reopen, and shutoff access to the surrounding zone.

In an operational method of the completion system 10, pressure is increased to rupture the disc 50 in the toe sleeve 18 to move the first sleeve 44 and open the string 16 for circulation. Subsequently, a first object such as, but not limited to, first ball 70 (see FIG. 4) is pumped down. Before the first ball 70 reaches the toe sleeve 18 however, the first ball 71) lands in an object seat/ball seat of a first sleeve 76 of the sleeve assembly 20 (see FIG. 3) also positioned in the first stage 26 of the completion system 10.

Figure 3:
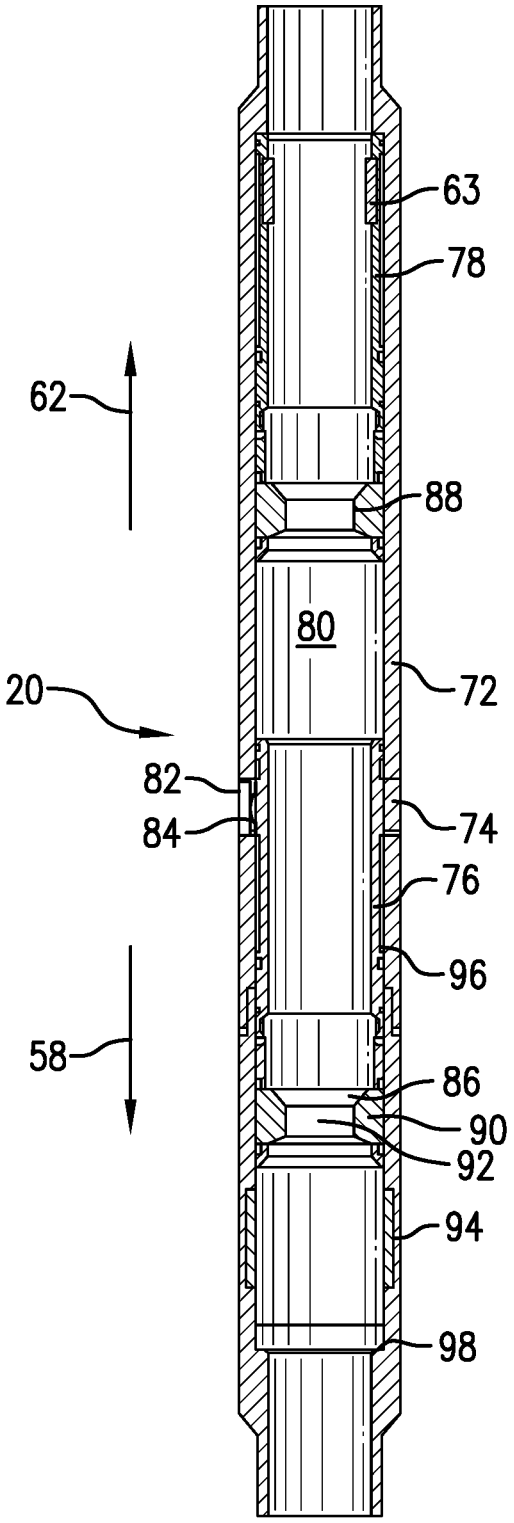
FIG. 3 depicts an interior view of an embodiment of a sliding sleeve assembly for the completion system of FIG. 1.

As depicted in FIG. 3, the sleeve assembly 20 includes a housing 72 having one or more ports 74 extending radially therethrough and a first sleeve 76 and a second sleeve 78 movable axially within the housing 72. In an initial condition of the sleeve assembly 20, the first sleeve 76 is positioned to block the ports 74, such that communication between an interior 80 of the sleeve assembly 20 and the surrounding zone of the borehole 12 is not permitted through the ports 74. At least the first sleeve 76 is temporarily fixed, such as through the use of shear pins 48 (see FIG. 2), to restrict axial movement of the first sleeve 76 in this initial condition. The ports 74 are initially plugged with a consumable plug 82, such as a magnesium Mg plug, or a consumable plug 82 and/or a rupture disc 84, to assure that the opening object (such as any of balls 70, 170, 270, depending on which stage the sleeve assembly 20 is positioned) continues on in the downhole direction 58 to operate sleeves below. The disc 84 would be rupturable in the bottom tool of the stage and acid tailing the object would consume the consumable plug 82 to fully open all ports 74 for treatment.

The first and second sleeves 76, 78 of the sleeve assembly 20 each include a segmented ball seat 86, 88, respectively, although collets or other profiles are also employable that can catch and release an object in a downhole environment. The term "object seat" will denote any of a ball seat, collet, profile that can catch and release an object in a downhole environment. As illustrated, the ball seats 86, 88 include a plurality of segments (dogs) 90, that extend through windows and are circumferentially spaced within the housing 72 so as to create an opening 92 that is smaller than a diameter of the ball which it is to receive. When the ball seat 86, 88 receives the ball thereon, and pressure is increased uphole of the ball, the sleeve 76, 78 (after shearing any shear pins 48 restraining the sleeve 76, 78 from movement) will shift axially in the downhole direction 58. During axial displacement of the sleeve 76, 78 and the segments 90 that form the ball seat, the ball seat 86, 88 lines up with a groove 94, 96 in the housing 72 and then the segments 90 expand radially outward into the groove 94, 96 so that the inner diameter of the opening 92 of the ball seat 86, 88 is increased to a size larger than the diameter of the ball, and the ball can pass further downhole. It should be understood that the groove 94, 96 has a larger inner diameter than an inner diameter of the housing 72 where the ball seat 86, 88 is located at an initial position of the sleeve 76, 78. Thus, the ball seats 86, 88 expand to permit passage of the received balls once the respective sleeves 76, 78 have been shifted. Also, the ball seats 86, 88 may be formed of a material that is drillable.

When the first sleeve 76 is opened by the ball as described above, the port 74 is opened. Additional movement of the first sleeve 76 in the downhole direction 58 can be prohibited by a shoulder 98 in the housing 72. To close the port 74, a ball sized to be received by the ball seat 88 in the second sleeve 78 is pumped downhole onto the ball seat 88 in the second sleeve 78 and pressure is increased to move the second sleeve 78 in the downhole direction 58 until the ports 74 are closed. The second sleeve 78, positioned uphole of the first sleeve 76, may abut against the first sleeve 76 during the closing operation. The second sleeve 78 includes a shifting profile 63 to enable pulling the second sleeve 78 back in the uphole direction 62, thus opening the port 74 for production and to enable pushing the second sleeve 78 back in the downhole direction 58 to close the port 74 and shut off the zone. Thus, the sleeve assembly 20, which can be run in multiple instances per stage, is usable for a variety of procedures including acid stimulation, testing, closing, reopening for production, and shutoff.

Figure 4:
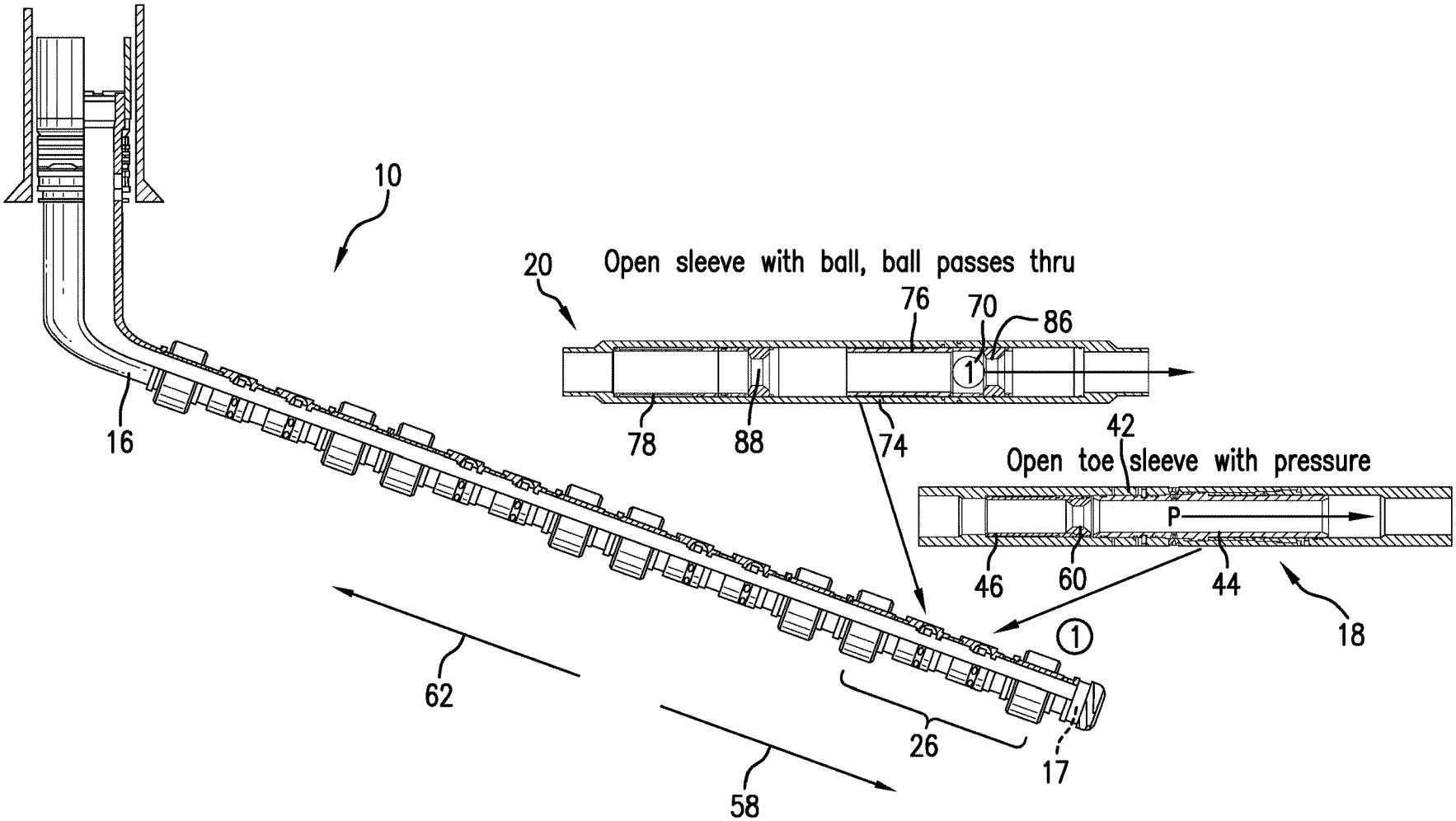
FIG. 4 depicts a schematic view of an operation in a first stage of the completion system of FIG. 1 employing the toe sleeve 18 of FIG. 2 and the sliding sleeve assembly of FIG. 3.

Turning now to FIG. 4, additional procedures in embodiments of the operational method of the completion system 10 are schematically depicted. With the toe sleeve 18 positioned in the first stage 26, after pressuring up within the string 16, the disc 50 (FIG. 2) is ruptured and the first sleeve 44 moves axially in the downhole direction 58 to open the ports 42 in order to open the string 16 for circulation. Subsequently, a first ball 70 is pumped down to land on the ball seat 86 in the first sleeve 76 of the sleeve assembly 20 (as described with respect to FIG. 3) also positioned in the first stage 26. It should be understood that, in order for the first ball 70 to land in the ball seat 86 of the first sleeve 76, the ball 70 must pass through the ball seat 88 of the second sleeve 78, and therefore the initial inner diameter of the ball seat 86 of the first sleeve 76 is smaller than the initial inner diameter of the ball seat 88 of the second sleeve 78. Pressure above the ball 70 shears the pins 48 of the first sleeve 76 and shifts the first sleeve 76 in the downhole direction 58 to expose the ports 74 in the sleeve assembly 20. The consumable plugs 82 in the ports 74 assure ball function then are consumable by acid (in one embodiment, magnesium plugs are consumed in less than 15 minutes). Meanwhile, the ball seat 86 expands radially outward once the ball seat 86 is axially aligned with the groove 94 in the housing 72 of the sleeve assembly 20, and the ball 70 is then capable of passing through the ball seat 86 of the first sleeve 76 of the sleeve assembly 20. The ball 70 then passes through the ball seat 60 of the second sleeve 46 of the toe sleeve 18, through the first sleeve 44 of the toe sleeve 18, and lands above the wellbore isolation valve 17.

With both the sleeve assembly 20 and the toe sleeve 18 in an "open" position (ports 74, 42 unobstructed by any sleeve, allowing fluidic communication between the interior of the string 16 and the first zone of the borehole 12), the first stage 26 is stimulated. In one embodiment, this process includes stimulating the first stage 26 with 15% HCL treatment and up to 4,000 psi differential at the open hole packers 24. A flowback production test is also performed from the first stage 26.

With reference now to FIG. 5, further processes of the operational method of the completion system 10 are schematically depicted. The operational method will be described with reference to the illustrated embodiment of two sleeve assemblies 20 per stage, however other embodiments may include greater or fewer sleeve assemblies 20 per stage. With first and second sleeve assemblies 20 positioned in the second stage 28, and with the first sleeve assembly 20 positioned further downhole than the second sleeve assembly 20, a second ball 170 is pumped down to land in the ball seat 86 of a first sleeve 76 in the second sleeve assembly 20 (upholemost within the second stage 28). Pressure above the ball shears the pins 48 and shifts the first sleeve 76 in the downhole direction 58 to expose the ports 74. Once axially aligned with the groove 94 in the housing 72 (FIG. 3), the ball seat 86 expands radially outward to pass the second ball 170 therethrough. The consumable plugs 82 (FIG. 3) in the ports 74 assure ball function and are then consumed, such as within less than 1.5 minutes by the acid. Meanwhile, the second ball 170 passes on in the downhole direction 58 to the first sleeve assembly 20 within the second stage 28 and lands on the ball seat 86 of the first sleeve 76 in the first sleeve assembly 20 to open the ports 74 in the first sleeve assembly 20, exposing the consumable plugs 82 in the port 74 as within the second sleeve assembly 20.

The second ball 170 continues in the downhole direction 58 to land on the ball seat 88 of the second sleeve 78 of the sleeve assembly 20 in the first stage 26, pushing the second sleeve 78 in the axial downhole direction 58 over the ports 74 (which has been previously opened by the first ball 70 as previously described) and releasing the second ball 170 to travel to the toe sleeve 18 after the ball seat 88 has radially expanded into the grooves 96 in the housing 72 (FIG. 3). With the second ball 170 on the ball seat 60 in the toe valve 18, the second sleeve 46 in the toe sleeve 18 is also pushed in the downhole direction 58 to cover the ports 42 in the toe sleeve 18 (which had been previously uncovered by hydraulic pressure moving the sleeve 44 as previously described with respect to FIG. 2). Pressuring up blows the discs 84 in the ports 74 (see FIG. 3) of the second stage sleeve assembly 20, and acid consumes the consumable plugs 82 such that all of the second stage ports 74 are opened. Thus, using the second ball 170, the first and second sleeve assemblies 20 in the second stage 28 are opened while the sleeve assembly 20 and the toe sleeve 18 in the first stage 26 are closed. The second stage 28 can then be stimulated, such as with 15% HCL treatment and flowback production test performed from the second stage 28.

Figure 6:
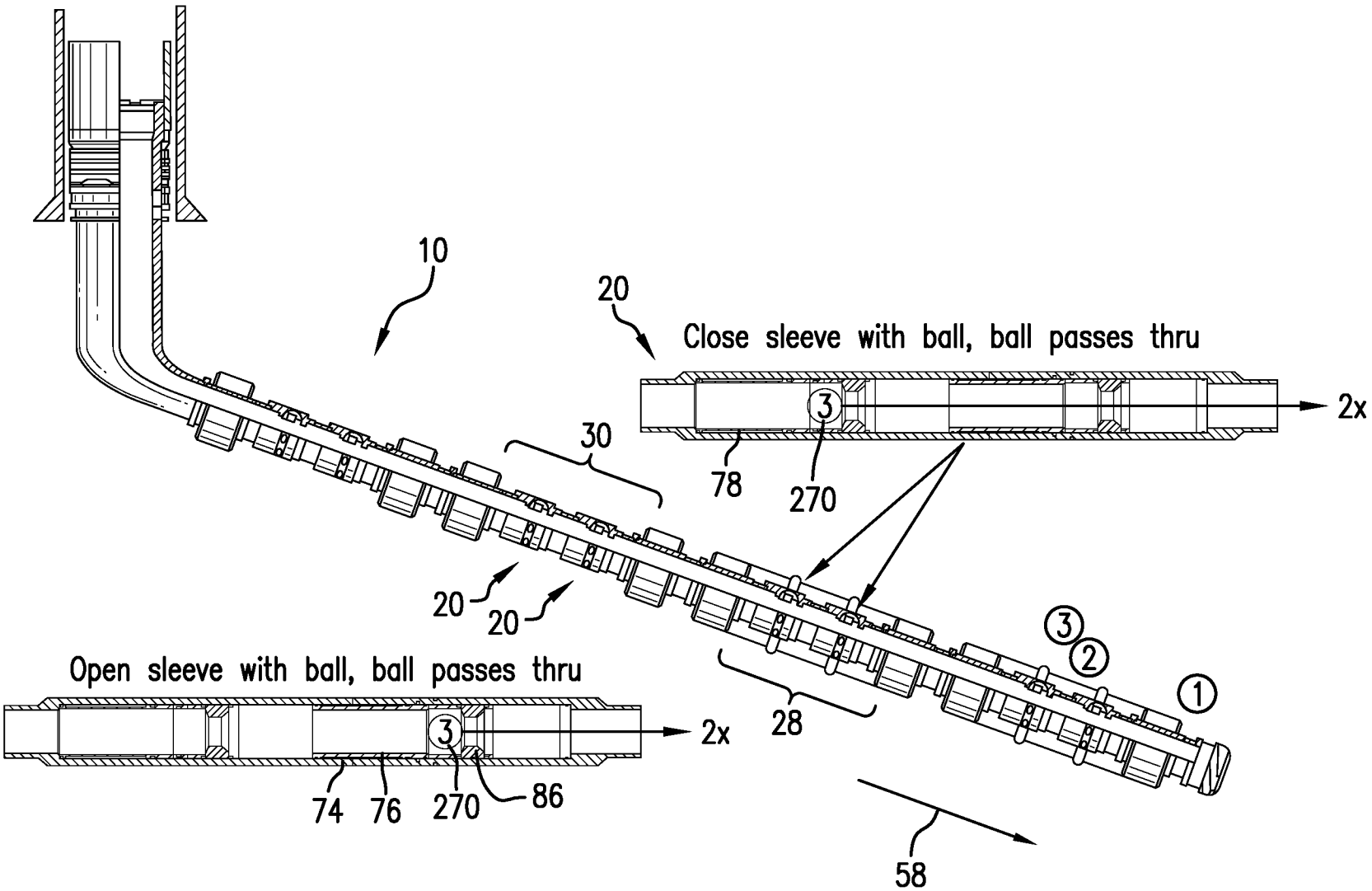
FIG. 6 depicts a schematic view of operations in second and third stages of the completion system of FIG. 1 employing the toe sleeve 18 of FIG. 2 and the sliding sleeve assembly of FIG. 3.

Turning now to FIG. 6, with two sleeve assemblies 20 positioned in the third stage 30, a third ball 270 pumped downhole will land in the first sleeve 76 of a second sleeve assembly 20 within the third stage 30 to open the ports 74 in the second sleeve assembly 20. Pressuring above the third ball 270 shears the pins 48 and shifts the first sleeve 76 in a downhole direction 58 to open the ports 74. The ball seat 86 will radially expand into the groove 94 of the housing 72 (FIG. 3) to pass the third ball 270, and the consumable plugs 82 in the ports 74 in the second sleeve assembly 20 assure ball function, which are consumable by acid. The third ball 270 then shifts the first sleeve 76 of a first sleeve assembly 20 to open the ports 74 in the first sleeve assembly 20 of the third stage 30, exposing the consumable plugs 82 and disc 84 (FIG. 3). The third ball 270 is released from the first sleeve assembly 20 after the ball seat 86 radially expands into the groove 94 of the housing 72 (FIG. 3).

The third ball 270 continues in the downhole direction 58 to the second stage 28 to shift the second sleeve 78 of the second sleeve assembly 20 and then the second sleeve 78 of the first sleeve assembly 20 to the closed position over the ports 74 in the first and second sleeve assemblies 20 of the second stage 28 (which had been previously opened by the second ball 170 as previously described). Pressuring up blows the discs 84 in the ports 74 of the first sleeve assembly 20 in the third stage 30, and acid consumes the consumable plugs 82 thus opening all third stage ports 74 while all second stage ports 74 have been closed.

The above-described processes can be repeated for each additional zone to finish acid stimulations and flowback production tests per zone. Optionally, sleeves in the upper zone can be closed off to close off the well prior to placing it on production. Also, while first and second sleeve assemblies 20 have been disclosed in multiple zones, it would be in the scope of these embodiments to provide additional sleeve assemblies 20 in each zone. One or more sleeves in a first stage utilizes an object to close the one or more sleeves, while that same object was previously used to open one or more sleeves in a second stage uphole of the first stage.

It should further be understood that graduated balls 70, 170, 270 and ball seats 86, 88 are used to open multiple sleeves per stage with a single frac ball. For example, the above-described second ball 170 is sized to land in the first sleeve 76 of the first and second sleeve assemblies 20 but first passes through the second sleeves 78 of the first and second sleeve assemblies 20 in the second stage 28 (and also passes through the ball seats 86, 88 of seat assemblies 20 in all stages uphole of the second stage 28). Thus, the ball seats 88 of the second sleeves 78 have a larger inner diameter (in the non-expanded initial condition) than the ball seats 86 of the first sleeves 76 of the first and second sleeve assemblies 20 in the second stage 28 (and all ball seats 86, 88 uphole of the second stage 28 have a larger inner diameter than the ball seats 86 of the first sleeves 76 of the first and second sleeve assemblies 20 in the second stage 28). Then, the third ball 270 lands on the ball seat 86 of the first sleeve 76 of the sleeve assemblies 20 of the third stage 30, but first passes through the second sleeves 78 of the first and second sleeve assemblies 20 in the third stage 30 (and also passes through the ball seats 86, 88 of seat assemblies 20 in all stages uphole of the third stage). Thus, the ball seats 88 of the second sleeves 78 have a larger inner diameter than the ball seats 86 of the first sleeves 76 of the first and second sleeve assemblies 20 in the third stage 30. Furthermore, the third ball 270 lands on the first sleeves 76 of the first and second sleeve assemblies 20 in the third stage 30, whereas the second ball 170 did not, because the third ball 270 has a larger outer diameter than the second ball 170. Therefore, the third ball 270 is able to land in and close the second sleeves 78 of the first and second sleeve assemblies 20 in the second stage 28, whereas the second ball 170 passed through the second sleeves 78 of the first and second sleeve assemblies 20 in the second stage 28 without landing on the ball seats 88 therein. Thus, each ball, starting with the first ball 70 and continuing the third ball 270 and beyond, gradually increases in size.

In the initial non-expanded condition (where none of the ball seats have been radially expanded into the housing of the sleeve assemblies), the inner diameter of the ball seats 86 also increase in the uphole direction, That is, the inner diameter of the ball seat 86 in the first stage 26 is smaller than the inner diameter of the ball seats 86 in the second stage 28, which in turn have a smaller inner diameter than the ball seats 86 in the third stage 30, etc. Further, the inner diameter of the ball seats 88 increase in the uphole direction. That is, the inner diameter of the ball seat 88 in the first stage 26 (which is larger than the inner diameter of the ball seat 86 in the first stage 26) is smaller than the inner diameter of the ball seats 88 in the second stage 28 (which are larger than the inner diameter of the ball seats 86 in the second stage 28), and the inner diameter of the ball seats 88 in the second stage 28 are smaller than the inner diameter of the ball seats 88 in the third stage 30, etc. Also, for the initial non-expanded condition, the inner diameter of the ball seat 88 in the first stage 26 may have the same or approximately same inner diameter of the ball seats 86 in the second stage 28, the inner diameter of the ball seats 88 in the second stage 28 may have the same or approximately same inner diameter of the ball seats 86 in the third stage 30, the inner diameter of the ball seats 88 in the third stage 30 may have the same or approximately same inner diameter of the ball seats 86 in the fourth stage 32, and so on.

After the above-described processes of acid stimulations and flowback production tests are repeated and completed per zone, the well can be optionally closed off by closing sleeves in an upper zone prior to the well being placed on production.

Figure 7:
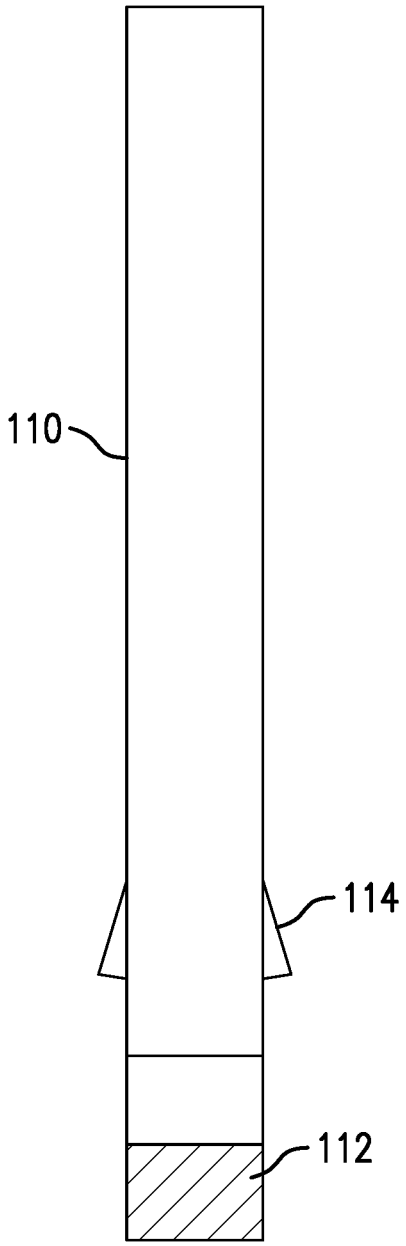
FIG. 7 depicts a schematic view of a coiled tubing having milling tool and a shifting tool.

Subsequent the circulation, acid stimulations, flowback production tests and optional well closure, and prior to placing the completion system 10 on production, the ball seats 86, 88 can be milled out using coiled tubing 110 having a milling tool 112 schematically depicted in FIG. 7. The balls 70, 170, 270 may be disintegrable balls and thus disintegrated.

While pulling the coiled tubing 110 out of the hole in the uphole direction 62, a shifting tool 114 on the coiled tubing 110 engages with the shifting profile 63 in the sleeve 46 of the toe sleeve 18 and engages with the shifting profiles 63 in the second sleeves 78 of the sleeve assemblies 20 to reveal the ports 42, 74 that had been previously covered by the sleeves 46, 78, respectively. The completion system 10 is then placed on production. Optionally, specific zones can be subsequently shut by employing a reclosing sleeve using a shifting tool on coiled tubing 110 or wireline. Thus, completion system 10 and method utilizes sleeve assembly 20 for stimulation, closure of the system 10 for test integrity and reopen for production. The sleeve assembly 20 allows two balls, such as 70, 170, to be used and pass the inner diameter therethrough as opposed to a single device that is caught then requires time to dissolve. This will increase efficiency by not having to rig up additional resources as to rig up coil and or stick pipe.

An embodiment of a method of employing the completion system 10 in a plurality of downhole operations includes setting the packers 24, opening the circulation path by shifting the hydraulically openable sleeve 44 to reveal the port 42 in the housing 44 of the toe sleeve 18, acid stimulating the first stage 26 by landing the first ball 70 on the ball seat 86 of the first sleeve 76 of the first sleeve assembly 20, pressuring above the first ball 70 to shift the first sleeve 76 of the first sleeve assembly 20 to reveal the port 74 in the housing 72 of the first sleeve assembly 20, and dissolving the consumable plug 82 positioned in the port 74 of the housing 72 of the first sleeve assembly 20 with acid; performing flowback production test from the first stage 26; acid stimulating the second stage 28 by landing the second ball 170 on the ball seat 86 of the first sleeve 76 of the second sleeve assembly 20, pressuring above the second ball 170 to shift the first sleeve 76 of the second sleeve assembly 20 to reveal the port 74 in the housing 72 of the second sleeve assembly 20, and dissolving the consumable plug 82 positioned in the port 74 of the housing 72 of the second sleeve assembly 20 with acid; closing the ports 74 in the first sleeve assembly 20 and the toe sleeve 18 using the second ball 170, performing flowback production test from the second stage 28; closing the port 74 in the second sleeve assembly 20 using a third ball 270; and producing formation fluids through the string 16 by engaging shifting profiles 63 in the second sleeves 78 of the first and second sleeve assemblies 20 with a shifting tool 114 to uncover the ports 74 in the first and second sleeve assemblies 20.

Set forth below are some embodiments of the foregoing disclosure:

Embodiment 1: A method of conducting a plurality of downhole operations with a completion system, the method including performing a treatment through a port in a first sleeve assembly in a first stage of the completion system, using an object to slide a first sleeve in a second sleeve assembly, located uphole of the first sleeve assembly, in a second stage of the completion system to reveal a port, and then closing the port in the first sleeve assembly in the first stage using the object, performing a treatment through the port in the second sleeve assembly, closing the port in the second sleeve assembly, and opening at least one of the ports in the first sleeve assembly and the second sleeve assembly and producing fluids through the at least one of the ports.

Embodiment 2: The method as in any prior embodiment, wherein performing the treatment through the port in the first sleeve assembly and performing the treatment through the port in the second sleeve assembly includes performing an acid stimulation treatment through the ports to stimulate a borehole wall.

Embodiment 3: The method as in any prior embodiment, wherein the port in the first sleeve assembly and the port in the second sleeve assembly each include a consumable plug to maintain sufficient pressure to pump the object therethrough, the method further comprising consuming the consumable plugs with acid from the acid stimulation treatment.

Embodiment 4: The method as in any prior embodiment, wherein the port in the second sleeve assembly further includes a disc, the method further comprising rupturing the disc prior to the acid stimulation treatment of the borehole wall in the second stage.

Embodiment 5: The method as in any prior embodiment, further comprising, prior to performing the treatment through the port in the first sleeve assembly, opening a port in a toe sleeve in the first stage and enabling circulation.

Embodiment 6: The method as in any prior embodiment, wherein the toe sleeve includes a first sleeve having a rupture disc, and opening the port in the toe sleeve includes pressuring up within the first sleeve to rupture the rupture disc and dump pressure on a piston to shift the first sleeve and uncover the port in the toe sleeve.

Embodiment 7: The method as in any prior embodiment, wherein the toe sleeve further includes an object closable sleeve having an object seat, the method further comprising, after closing the port in the first sleeve assembly in the first stage with the object, closing the port in the toe sleeve with the object landing on the object seat in the object closable sleeve of the toe sleeve.

Embodiment 8: The method as in any prior embodiment, further comprising, prior to performing the treatment through the port in the first sleeve assembly in the first stage of the completion system, opening a first sleeve of the first sleeve assembly using a first object landed on an object seat in the first sleeve, wherein the object used to slide the first sleeve in the second sleeve assembly in the second stage of the completion system is a second object having a greater diameter than the first object.

Embodiment 9: The method as in any prior embodiment, further comprising a plurality of second sleeve assemblies in the second stage, the method including sliding the first sleeve in each second sleeve assembly using the second object.

Embodiment 10: The method as in any prior embodiment, wherein the second sleeve assembly further includes a second sleeve, wherein closing the port in the second sleeve assembly comprises using a third object to shift the second sleeve to cover the port in the second sleeve assembly, wherein the third object has a greater diameter than the second object.

Embodiment 11: The method as in any prior embodiment, prior to using the third object to shift the second sleeve to cover the port in the second sleeve assembly, using the third object to open a port in a third stage isolated from the second stage.

Embodiment 12: The method as in any prior embodiment, wherein the first and second sleeve assemblies include object seats to receive and release the object therethrough, the method further comprising milling out the object seats subsequent treatment performed through each stage of the completion system.

Embodiment 13: The method as in any prior embodiment, wherein opening at least one of the ports in the first sleeve assembly and the second sleeve assembly for production includes engaging a shifting tool with a shifting profile on a sleeve that is located over at least one of the ports.

Embodiment 14: The method as in any prior embodiment, wherein the first and second sleeve assemblies include object seats for receiving and releasing the object therethrough, the method further comprising milling out the object seats on coiled tubing subsequent completion of treatment performed through each stage of the completion system, wherein the shifting tool for opening at least one of the ports is on the coiled tubing.

Embodiment 15: The method as in any prior embodiment, further comprising flowback testing through the port in the first sleeve assembly and flowback testing through the port in the second sleeve assembly subsequent treatment and prior to production.

Embodiment 16: A completion system including a string of downhole tools arranged for a plurality of downhole operations, the completion system including settable packers arranged to separate adjacent stages of the string from each other, a toe sleeve in a first stage of the string, the toe sleeve including a housing, a radial port in the housing, a hydraulically openable sleeve initially arranged to cover the port, and an object-activated sleeve having an object seat, the hydraulically openable sleeve slidable to reveal the port to open a circulation path, a first sleeve assembly in the first stage, the first sleeve assembly including a housing having a radial port, a first sleeve having an object seat, the first sleeve initially arranged to cover the port in the housing of the first sleeve assembly, a consumable plug positioned in the port, and a second sleeve having an object seat, a second sleeve assembly in a second stage of the string, the second sleeve assembly including a housing having a radial port, a first sleeve having an object seat, the first sleeve of the second sleeve assembly initially arranged to cover the port in the housing of the second sleeve assembly, a consumable plug positioned in the port in the housing of the second sleeve assembly, and a second sleeve having an object seat, wherein the first sleeve in the first sleeve assembly is movable to reveal the port in the housing of the first sleeve assembly upon receipt of an object in the object seat of the first sleeve in the first sleeve assembly, the first sleeve of the second sleeve assembly is movable to reveal the port in the housing of the second sleeve assembly upon receipt of a second object in the object seat of the second sleeve in the second sleeve assembly, the second sleeve in the first sleeve assembly is movable to close the port in the housing of the first sleeve assembly upon receipt of the second object in the object seat of the second sleeve in the first sleeve assembly, and the object-activated sleeve in the toe sleeve is movable to close the port in the toe sleeve upon receipt of the second object.

Embodiment 17: The completion system as in any prior embodiment, wherein the second object has a greater diameter than the first object, and the first object is passable through the toe sleeve after release from the first sleeve assembly in the first stage.

Embodiment 18: The completion system as in any prior embodiment, wherein the hydraulically openable sleeve includes a rupture disc arranged to dump pressure on a piston to shift the hydraulically openable sleeve and reveal the port in the housing of the toe sleeve.

Embodiment 19: The completion system as in any prior embodiment, wherein the second sleeve in the first sleeve assembly and the second sleeve in the second assembly include a shifting profile configured to engage with a shifting tool to shift the second sleeves and uncover the ports in the housings of the first and second sleeve assemblies to enable production of formation fluids through the string.

Embodiment 20: The completion system as in any prior embodiment, wherein the consumable plugs are consumable by an acid from an acid stimulation treatment.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of conducting a plurality of downhole operations with a completion system, the method comprising:

opening a toe sleeve assembly port in a toe sleeve assembly in a first stage of the completion system and enabling circulation;

performing a treatment through a first sleeve assembly port in a first sleeve assembly and through the toe sleeve assembly port in the first stage of the completion system;

using an object in a second sleeve assembly, the second sleeve assembly located uphole of the first sleeve assembly and in a second stage of the completion system, the second sleeve assembly including a second sleeve assembly first sleeve and a second sleeve assembly port, using the object to slide the second sleeve assembly first sleeve to reveal the second sleeve assembly port, and then closing the first sleeve assembly port and the toe sleeve assembly port using the object;

performing a treatment through the second sleeve assembly port;

closing the second sleeve assembly port; and opening at least one of the first and second sleeve assembly ports and producing fluids through the at least one of the first and second sleeve assembly ports.

2. The method of claim 1, wherein performing the treatment through the first sleeve assembly port and the toe sleeve assembly port and performing the treatment through the second sleeve assembly port includes performing an acid stimulation treatment through the first sleeve assembly and toe sleeve assembly ports and through the second sleeve assembly port to stimulate a borehole wall.

3. The method of claim 2, wherein the first sleeve assembly port and the second sleeve assembly port each include a consumable plug to maintain sufficient pressure to pump the object therethrough, the method further comprising consuming the consumable plugs with acid from the acid stimulation treatment.

4. The method of claim 3, wherein the second sleeve assembly port further includes a disc, the method further comprising rupturing the disc prior to the acid stimulation treatment of the borehole wall in the second stage.

5. The method of claim 1, wherein the toe sleeve assembly includes a toe sleeve assembly first sleeve and a toe sleeve assembly second sleeve, the toe sleeve assembly first sleeve hydraulically openable to reveal the toe sleeve assembly port and the toe sleeve assembly second sleeve closable to close the toe sleeve assembly port.

6. The method of claim 1, wherein the toe sleeve assembly includes a toe sleeve assembly first sleeve having a rupture disc, and opening the toe sleeve assembly port includes pressuring up within the toe sleeve assembly first sleeve to rupture the rupture disc and dump pressure on a piston to shift the toe sleeve assembly first sleeve and uncover the toe sleeve assembly port.

7. The method of claim 1, wherein the object is a second object, and further comprising, prior to performing the treatment through the first sleeve assembly port, opening a first sleeve assembly first sleeve of the first sleeve assembly using a first object landed on a first sleeve assembly object seat in the first sleeve assembly first sleeve; the second object having a greater diameter than the first object.

8. The method of claim 7, further comprising a plurality of second sleeve assemblies in the second stage, the method including sliding the second sleeve assembly first sleeve in each second sleeve assembly using the second object.

9. The method of claim 7, wherein the second sleeve assembly further includes a second sleeve assembly second sleeve, wherein closing the second sleeve assembly port comprises using a third object to shift the second sleeve assembly second sleeve to cover the second sleeve assembly port, wherein the third object has a greater diameter than the second object.

10. The method of claim 9, prior to using the third object to shift the second sleeve assembly second sleeve to cover the second sleeve assembly port, using the third object to open a third sleeve assembly port in a third sleeve assembly in a third stage isolated from the second stage.

11. The method of claim 1, wherein the first and second sleeve assemblies include object seats to receive and release the object therethrough, the method further comprising milling out the object seats subsequent treatment performed through each stage of the completion system.

12. The method of claim 1, wherein opening at least one of the first and second sleeve assembly ports for production includes engaging a shifting tool with a shifting profile on at least one of a first and second sleeve assembly second sleeve that is located over at least one of the first and second sleeve assembly ports.

13. The method of claim 12, wherein the first and second sleeve assemblies include object seats for receiving and releasing the object therethrough, the method further comprising milling out the object seats on coiled tubing subsequent completion of treatment performed through each stage of the completion system, wherein the shifting tool for opening at least one of the first and second sleeve assembly ports is on the coiled tubing.

14. The method of claim 1, further comprising flowback testing through the first sleeve assembly port and flowback testing through the second sleeve assembly port subsequent treatment and prior to production.

15. A method of conducting a plurality of downhole operations with a completion system, the method comprising:

opening a toe sleeve assembly port in a toe sleeve assembly in a first stage of the completion system and enabling circulation, the toe sleeve assembly including a toe sleeve assembly first sleeve having a rupture disc, and opening the toe sleeve assembly port includes pressuring up within the toe sleeve assembly first sleeve to rupture the rupture disc and dump pressure on a piston to shift the toe sleeve assembly first sleeve and uncover the toe sleeve assembly port;

performing a treatment through a first sleeve assembly port in a first sleeve assembly in the first stage of the completion system;

using an object to slide a second sleeve assembly first sleeve in a second sleeve assembly in a second stage of the completion system, the second sleeve assembly located uphole of the first sleeve assembly, to reveal a second sleeve assembly port, and then closing the first sleeve assembly port using the object;

performing a treatment through the second sleeve assembly port;

closing the second sleeve assembly port; and opening at least one of the first and second sleeve assembly ports and producing fluids through the at least one of the first and second sleeve assembly ports;

wherein the toe sleeve assembly further includes a toe sleeve assembly second sleeve having an object seat, and after closing the first sleeve assembly port in the first stage with the object, closing the toe sleeve assembly port in the toe sleeve assembly with the object landing on the object seat in the toe sleeve assembly second sleeve.

16. A completion system including a string of downhole tools arranged for a plurality of downhole operations, the completion system including:

settable packers arranged to separate adjacent stages of the string from each other;

a toe sleeve assembly in a first stage of the string, the toe sleeve assembly including a toe sleeve assembly housing, a toe sleeve assembly radial port in the toe sleeve housing, a hydraulically openable toe sleeve assembly first sleeve initially arranged to cover the toe sleeve assembly port, and an object-activated toe sleeve assembly second sleeve having a toe sleeve assembly second sleeve object seat, the hydraulically openable toe sleeve assembly first sleeve slidable to reveal the toe sleeve assembly port to open a circulation path;

a first sleeve assembly in the first stage, the first sleeve assembly including a first sleeve assembly housing having a first sleeve assembly radial port, a first sleeve assembly first sleeve having a first sleeve assembly first sleeve object seat, the first sleeve assembly first sleeve initially arranged to cover the first sleeve assembly port in the first sleeve assembly housing, a first sleeve assembly consumable plug positioned in the first sleeve assembly port, and a first sleeve assembly second sleeve having a first sleeve assembly second sleeve object seat;

a second sleeve assembly in a second stage of the string, the second sleeve assembly including a second sleeve assembly housing having a second sleeve assembly radial port, a second sleeve assembly first sleeve having a second sleeve assembly first sleeve object seat, the second sleeve assembly first sleeve initially arranged to cover the second sleeve assembly port in the second sleeve assembly housing, a second sleeve assembly consumable plug positioned in the second sleeve assembly port in the second sleeve assembly housing, and a second sleeve assembly second sleeve having a second sleeve assembly object seat;

wherein the first sleeve assembly first sleeve is movable to reveal the first sleeve assembly port in the first sleeve assembly housing upon receipt of a first object in the first sleeve assembly first sleeve object seat, the second sleeve assembly first sleeve is movable to reveal the second sleeve assembly port in the second sleeve assembly housing upon receipt of a second object in the second sleeve assembly first sleeve object seat, the first sleeve assembly second sleeve is movable to close the first sleeve assembly port in the first sleeve assembly housing upon receipt of the second object in the first sleeve assembly second sleeve object seat, and the object-activated toe sleeve assembly second sleeve is movable to close the toe sleeve assembly port in the toe sleeve assembly upon receipt of the second object.

17. The completion system of claim 16, wherein the second object has a greater diameter than the first object, and the first object is passable through the toe sleeve assembly after release from the first sleeve assembly in the first stage.

18. The completion system of claim 16, wherein the hydraulically openable toe sleeve assembly first sleeve includes a rupture disc arranged to dump pressure on a piston to shift the hydraulically openable toe sleeve assembly first sleeve and reveal the toe sleeve assembly port in the toe sleeve assembly housing.

19. The completion system of claim 18, wherein the first sleeve assembly second sleeve and the second sleeve assembly second sleeve include a shifting profile configured to engage with a shifting tool to shift the first and second sleeve assembly second sleeves and uncover the first and second sleeve assembly ports in the first and second sleeve assembly housings to enable production of formation fluids through the string.

20. The completion system of claim 19, wherein the first and second sleeve assembly consumable plugs are consumable by an acid from an acid stimulation treatment.

* * * * *